US006783426B2

(12) United States Patent
Drown et al.

(10) Patent No.: US 6,783,426 B2
(45) Date of Patent: Aug. 31, 2004

(54) METHOD AND APPARATUS FOR DETECTION OF CHEMICAL MECHANICAL PLANARIZATION ENDPOINT AND DEVICE PLANARITY

(75) Inventors: Jennifer Lynne Drown, Orlando, FL (US); Kim Elshot, Orlando, FL (US); Erik Cho Houge, Orlando, FL (US); Tingkwan Cheung, Singapore (SG)

(73) Assignee: Agere Systems, Inc., Allentown, PA (US)

( * ) Notice: Subject to any disclaimer, the term of this patent is extended or adjusted under 35 U.S.C. 154(b) by 0 days.

(21) Appl. No.: 10/120,767

(22) Filed: Apr. 10, 2002

(65) Prior Publication Data

US 2003/0194945 A1 Oct. 16, 2003

(51) Int. Cl.[7] ..... B24B 49/00; B24B 51/00

(52) U.S. Cl. ..... 451/5; 451/8; 451/41; 451/54; 451/63

(58) Field of Search ..... 451/5, 8, 41, 54, 451/59, 63; 216/88, 89; 438/692, 693, 691

(56) References Cited

U.S. PATENT DOCUMENTS 5,504,328 A 4/1996 Bonser
5,766,497 A * 6/1998 Mitwalsky et al. ..... 216/56
6,121,147 A * 9/2000 Daniel et al. ..... 438/692
6,179,691 B1 * 1/2001 Lee et al. ..... 451/41
6,214,734 B1 4/2001 Bothra et al.
6,228,769 B1 * 5/2001 Li et al. ..... 438/692
6,309,276 B1 10/2001 Tsai et al.
6,517,668 B2 * 2/2003 Agarwal ..... 156/345.12
6,562,182 B2 * 5/2003 Agarwal ..... 257/1

* cited by examiner

*Primary Examiner*—Timothy V. Eley

(57) ABSTRACT

The present invention for a method and apparatus for detection of chemical mechanical planarization endpoint and device planarity comprises imparting at least one variation of an atomic mass of at least one material within the layer. The variation of the atomic mass within the layer is indicative of the layer thickness. The removal of the layer is monitored by detecting the variation in the atomic mass, and/or a change in concentration of the at least one material, during removal of the layer. Once the concentration of the material reaches a minimum threshold, or an atomic mass is detected at a minimum intensity, within a predetermined time duration, the removal of the layer is terminated. The variation in atomic mass, and/or concentration of materials within the layer is used to measure a planarity of the device.

28 Claims, 4 Drawing Sheets

METHOD AND APPARATUS FOR DETECTION OF CHEMICAL MECHANICAL PLANARIZATION ENDPOINT AND DEVICE PLANARITY

BACKGROUND OF THE INVENTION

This invention relates generally to chemical mechanical planarization (CMP) processes used in the manufacture of semiconductor devices. More specifically, the present invention pertains to techniques for determining an endpoint of CMP, and for determining the planarity of a semiconductor device.

As the number of interconnect layers in integrated circuit chips increases, the planarization of dielectric and metal layers has become more critical. Chemical mechanical planarization is a procedure used in the fabrication of semiconductor devices to planarize device topography in multilevel semiconductor processing. However, the process must be closely monitored for endpoint detection to avoid the removal of portions of a functional device layer.

Methods of determining an endpoint generally fall in two categories: in-line endpoint detection and in-situ endpoint detection. In-line endpoint detection measures film thickness prior to CMP and again after the device has been polished a predetermined time. However, this method assumes that CMP is a static process with a polish rate that is uniform through the device from die to die, or through a lot from device to device over multiple lots.

In-situ endpoint detection methods monitor film thickness in real time as films are being polished and/or removed. Such endpoint detection methods include front side laser interferometry, spectrometry-based endpoint, optical monitoring and motor-current monitoring, each of which is known in the art. For example, Applied Materials, Inc. has developed an in-situ removal monitor that employs a spectrometer reflective technique, in which a polishing pad is equipped with a laser and detector. Reflections of a laser beam off the device surface are detected and sampled to determine film thickness. Spectrometer-based endpoint detectors determine film thickness based on a change in intensity of reflected light. Motor-current endpoint detectors are responsive to motor loading changes caused by frictional changes at the device surface that may indicate a stop layer on the device.

Chemical mechanical planarization procedures inevitably generate debris consisting in part of a slurry and sacrificial layer particulate removed from the device surface. Endpoint detection systems have not employed a method for determining a CMP endpoint by analyzing the sacrificial effluent removed from the device surface.

Mass spectroscopy has been used for determining an endpoint for etch procedures in semiconductor device manufacturing but has not been contemplated or adapted for use in CMP processes. By way of example, an endpoint detection system for an etch procedure utilizing an ultraviolet mass spectrometer is disclosed in U.S. Pat. No. 5,504,328. The '328 patent uses mass spectroscopy to detect changes in the composition of reaction product gases during the etch procedure. The endpoint can be determined by noting a change in the gas composition caused by etching into a film of different material on the semiconductor device. The '328 patent does not disclose the use of the mass spectrometer for anything other than determining endpoint of an etch process.

In addition, mass spectroscopy has not been used to determine the planarity of semiconductor device topography. Planarity of a semiconductor device as used in this disclosure means the magnitude of the deviation from the mean topographic variance (or "roughness") of the device surface. The mean topographic variance is the average measure of "evenness" or "roughness" of the device surface. The topographic variance of a semiconductor device may be in the range of plus or minus 1500 A.

Planarity of a device surface is typically measured using in-line methods and is independent of end-point detection. For example, a metrology tool known as a ThermaWave Optiprobe, which is an optical measuring tool, is used to measure planarization after fabrication steps such as CMP. This type of instrument is used to measure oxide thickness and uniformity at several points on a semiconductor device to determine planarity.

SUMMARY OF THE INVENTION

The present invention provides an in-situ method for monitoring and determining the endpoint of a chemical mechanical planarization process (or CMP, also referred to as polishing) for semiconductor device manufacturing, and provides a method for monitoring and determining planarity of the device topography. Real time detection of the endpoint avoids the multiple steps required for in-line endpoint detection of CMP. In addition, the present invention utilizes spectral analyses to retrieve data from effluents produced in a CMP process.

For purposes of describing the present invention, a semiconductor device includes multiple layers of materials deposited or "grown" on a wafer substrate and may include one or multiple integrated circuits in what is generally referred to as a wafer. The layers are generally categorized as semiconductor, conductor or insulator layers. Alternatively, the layers incorporate the name of the material composing the layer such as dielectric layer, metal layer or oxide layer. The present invention is not limited to a specific type of layer; therefore, the term "device layer," as used herein, includes any type of layer on a semiconductor device that may be subject to chemical mechanical planarization.

The present invention imparts a variation in at least one atomic mass of at least one material within a layer formed over a substrate. The variation in the atomic mass is a function of the thickness of the layer. Removal of the layer, and endpoint of its removal, is monitored to detect the variation in atomic mass, and to measure concentration of the material being removed. Once the concentration of the material reaches, or approaches, a predetermined threshold, the removal of the layer is terminated.

In a preferred embodiment, the layer includes at least two isotopic variations of at least one material. The isotopic variations of the material are imparted within the material, as sacrificial layers. The sacrificial layers may comprise a first sacrificial layer and a last sacrificial layer. Wherein the terms "first" and "last" refer to the order in which the sacrificial layers are removed during polishing. Each of the sacrificial layers is comprised of the material (or layer material) with a spiking material distributed within the device layer. The atomic mass of the spiking material in the first sacrificial layer is different from the atomic mass of the spiking material in the last sacrificial layer.

During the CMP polishing process of the device layer using a suitable slurry material, samples of gas effluents of the slurry material are injected into a mass spectrometer. The mass spectrometer generates data indicative of the amount, or concentration of, the spiking material within the gas effluent which concentration is indicative of the degree of abrading of the sacrificial layer. The mass spectrometer thus provides a measurement of the concentration of selected material, such as the spiking material, over a predetermined time range.

A comparison of the concentration of compounds detected by the mass spectrometer, including the material of the device layer and the spiking material, and/or a comparison of the intensity of each spiking material to the range of distribution within which the materials are detected by the mass spectrometer, measures the planarity of the device surface.

The endpoint of the CMP is determined by a detection of a minimum intensity of the spiking material in the last sacrificial layer toward the end of the time range within which the spiking materials are detected.

DETAILED DESCRIPTION OF THE DRAWINGS

The present invention provides an in-situ method for monitoring an endpoint in a chemical mechanical planarization ("CMP" or polishing) fabrication step, used in the manufacture of semiconductor devices, and for monitoring planarity of a semiconductor device during CMP processing. The present invention is described in the context of chemical vapor deposition (CVP) and planarization of dielectric layers of semiconductor devices. However the invention is not limited to the specific deposition process or the application of the invention to a dielectric layer of a device. The present invention may be incorporated in any number of processes for depositing or growing any device layer, and planarization of such device layers.

In a preferred embodiment a layer formed over a substrate, comprises at least one material having at least one isotopic variation. The isotopic variation of the material is imparted within the layer such that the variation of atomic mass is a function of layer thickness. The variation takes the form of one or more sacrificial layers formed over a base layer. The sacrificial layers are removed leaving the base layer. The removal of the sacrificial layer is monitored in-situ, to detect an endpoint of the removal. In addition, concentration of the materials are measured to detect removal endpoint and planarity of the device.

Figure 1:
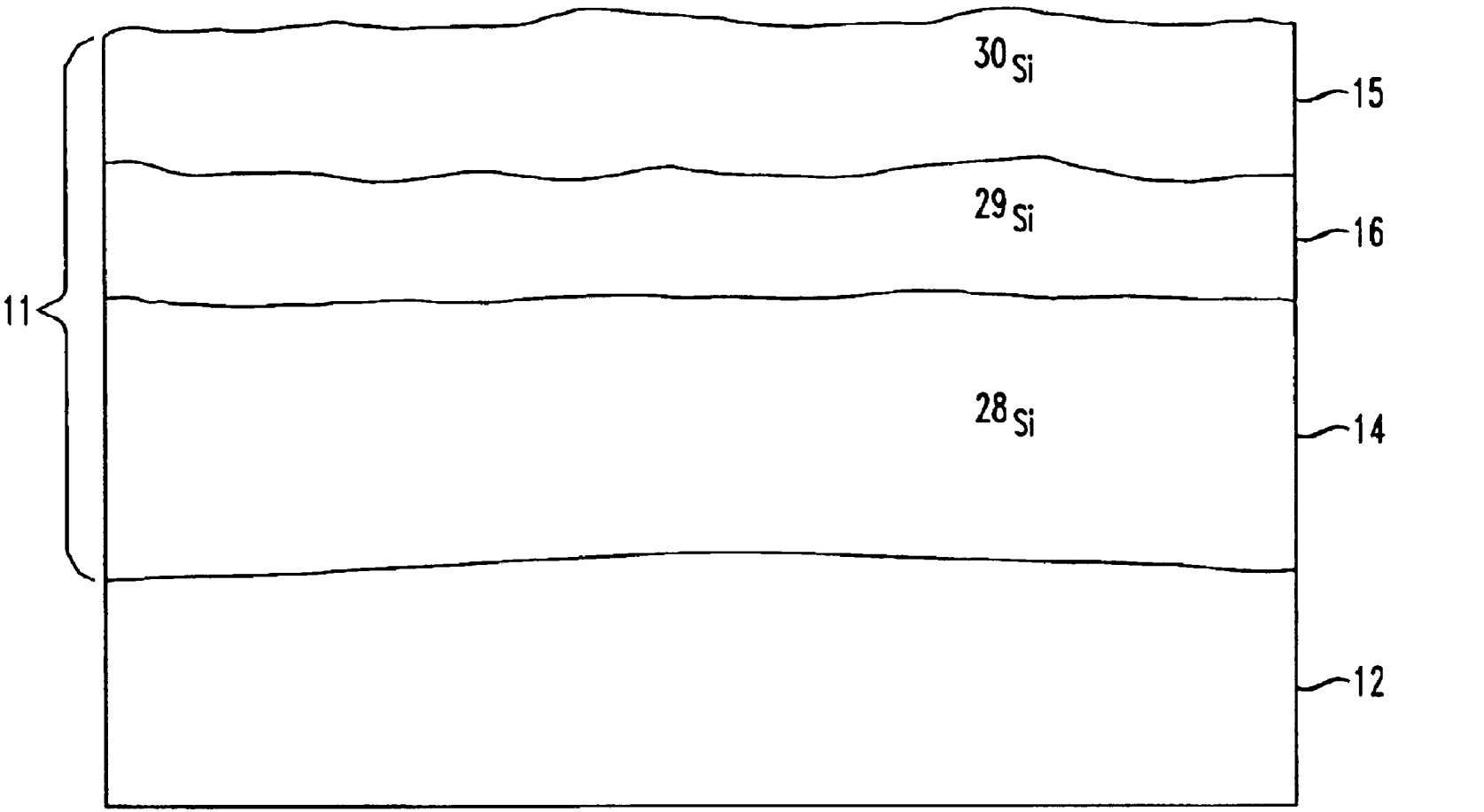
FIG. 1 is a sectional view of a semiconductor device incorporating the present invention.

In one embodiment of the present invention, two dielectric sacrificial layers are deposited over a dielectric base layer as shown in FIG. 1. The sacrificial layers include isotopic variations of the dielectric material. Silicon has three isotopes, $^{28}Si$, $^{29}Si$ and $^{30}Si$, in natural abundance of 92.2%, 4.7% and 3.1%, respectively. The sacrificial layers and the base dielectric layer may also be referred to as isotopic layers of the dielectric material. Many dielectric materials include silicon and its isotopic variations as materials of the dielectric material composition, such as silicon dioxide. In forming the sacrificial layers, additional amounts of the isotopes $^{28}Si$, $^{29}Si$ and $^{30}Si$ are injected separately in gaseous form, and in predetermined timed intervals, during the chemical vapor deposition of the dielectric material. Silicon isotopic variations are preferably used with a silicon-based dielectric material ($SiO_2$) because the silicon isotopes are not chemically reactive with the dielectric material, and otherwise do not inhibit the growth of the device layers.

The present invention need not be limited to CVD of a dielectric material in which isotopic variations of a compound are used to spike the dielectric material to create a sacrificial layer. Ion implantation may also be used to spike a device layer with different compounds such as boron, phosphorous and/or arsenic. For ion implantation, after a device layer is grown or deposited, a spiking material is distributed within a surface of the device layer using an ion implantation process. The device layer is then annealed to form a sacrificial layer having a substantially uniform distribution of the spiking material. A second spiking material is distributed within the device layer over the first sacrificial layer forming a second sacrificial layer. Each of the sacrificial layers has a spiking material that differs from the other, and the device material, in atomic mass. For example, the first spiking material may be boron, and the second spiking material may be arsenic.

With respect to FIG. 1, a dielectric material 11 is shown having been deposited over an oxide layer 12 of a semiconductor device 10. The dielectric material 11 has three isotopic layers including a dielectric base layer 14, a first sacrificial layer 15 and a last sacrificial layer 16. The base dielectric layer 14 remains as the dielectric layer on the semiconductor device 10, after polishing the device 10. The first sacrificial layer 15 and the last sacrificial layer 16 are removed during CMP.

Each of the three isotopes is injected during the deposition of the dielectric material to create the isotopic layers. Isotopic pure silicon process gases are commercially available, and a deposition system may be adapted for receiving the isotopes at selected timed intervals for deposition of the isotopic layers 14, 15 and 16. Chemical vapor deposition (CVD) is readily adapted for the injection of the isotopes during the deposition of the dielectric material. For example, a process gas for each of the silicon isotopes may be placed in fluid communication with the gaseous form of the dielectric material, and each of the isotopes $Si^{28}$, $Si^{29}$ and $Si^{30}$ injected with the dielectric material for selected time durations dependant on the desired overall thickness of the dielectric material and the desired thickness of each isotopic layer 14, 15 and 16.

The first isotope, $^{28}Si$, is injected in a gaseous form with the dielectric material for a sufficient amount of time corresponding to a nominal thickness (approximately 11,000 Å), of the dielectric base layer 14 of the semiconductor device 10. After this predetermined depth is achieved the process gas containing the isotope, $^{28}Si$, is shut off, and the process gas containing the isotope, $^{29}Si$, is injected. After a predetermined thickness of the last sacrificial layer 15 is reached, the process gas is terminated, and the isotope $^{30}Si$ is injected into the dielectric material until a predetermined thickness of the first sacrificial layer 16 is reached. The combined thickness of the first layer 15 and last layer 16 may range in thickness from 100 Å to about 1000 Å.

After the dielectric material 11 containing the isotopic layers 14, 15 and 16 is deposited and annealed, the semiconductor device is planarized using CMP. During the CMP process, the gas effluents produced by CMP are continuously analyzed by a mass spectrometer to determine the relative intensity of a given isotope at any point in time during the CMP process.

Figure 2:
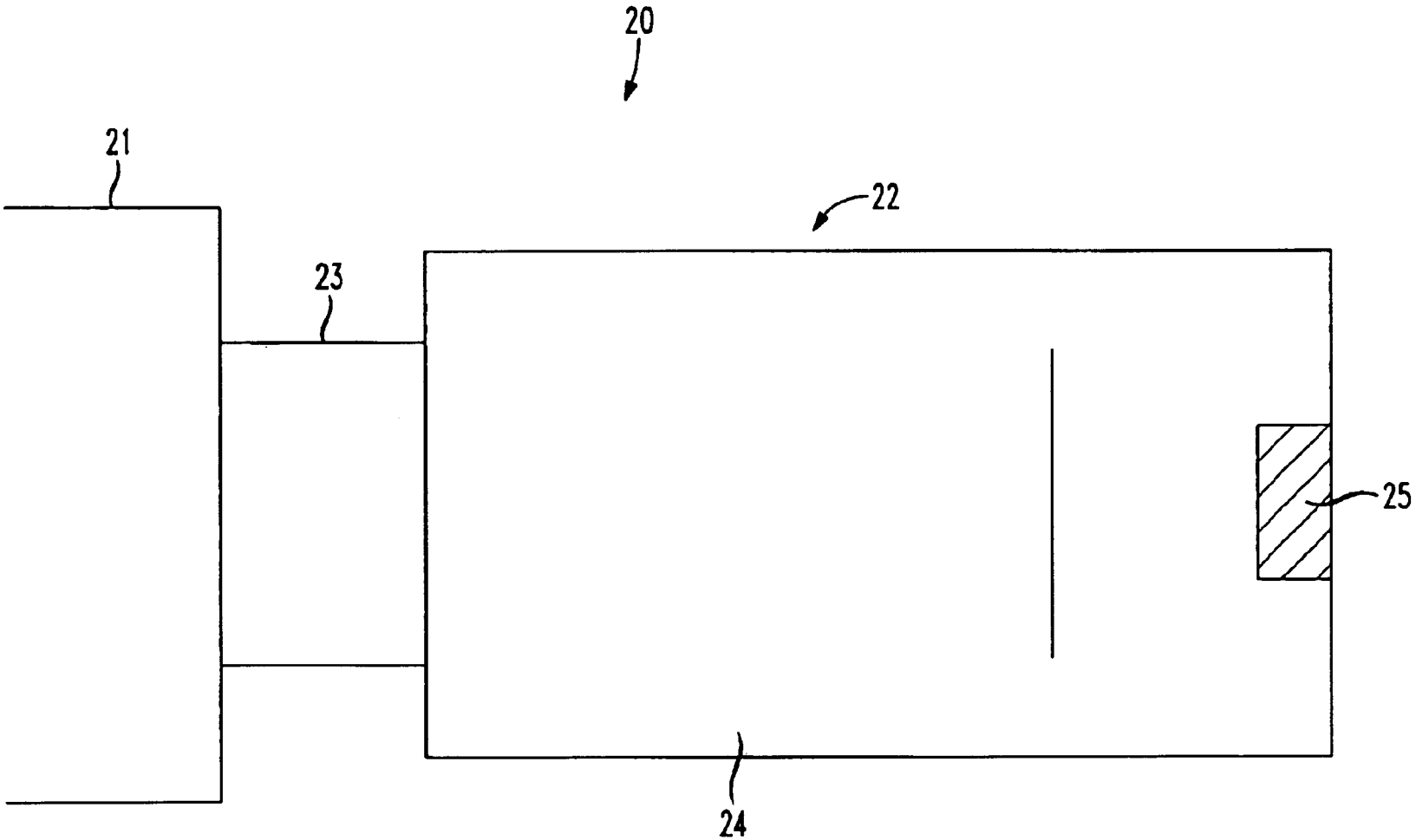
FIG. 2 is a schematic of a mass spectrometer and CMP station.

A schematic of a system 20 having polishing tool 21 placed in fluid communication with a mass spectrometer 22 is shown in the FIG. 2. The polishing tool 21 and mass spectrometer 22 are placed in sealing relationship within one another so samples of gas effluents created from the CMP process may be obtained and injected into the mass spectrometer 22 for analysis. An automated sampler 23, for automatically obtaining and injecting the gas samples, is attached in sealing relationship with the CMP tool 21. Such samplers 23 are available and readily adaptable by one skilled in the art for use in a given environment.

Once the gas samples are obtained and injected into an injection port (not shown) of the mass spectrometer. A carrier gas (not shown) directs the gas sample to an ionization chamber 24 in which compounds comprising the gas samples are ionized. The ions produced in the ionization chamber 24 are filtered, or sorted, according to their atomic mass (or mass/charge ratio). The ions are then focused to the detector 25, which is any available detector of a desired sensitivity to detect the isotopes. The detector 25 is tuned to a desired sensitivity and time range, to detect the isotopes of the dielectric material over a specified time range. The detection of the isotopes may be performed by a secondary ion mass spectroscopy or other known analytical technique.

Figure 3:
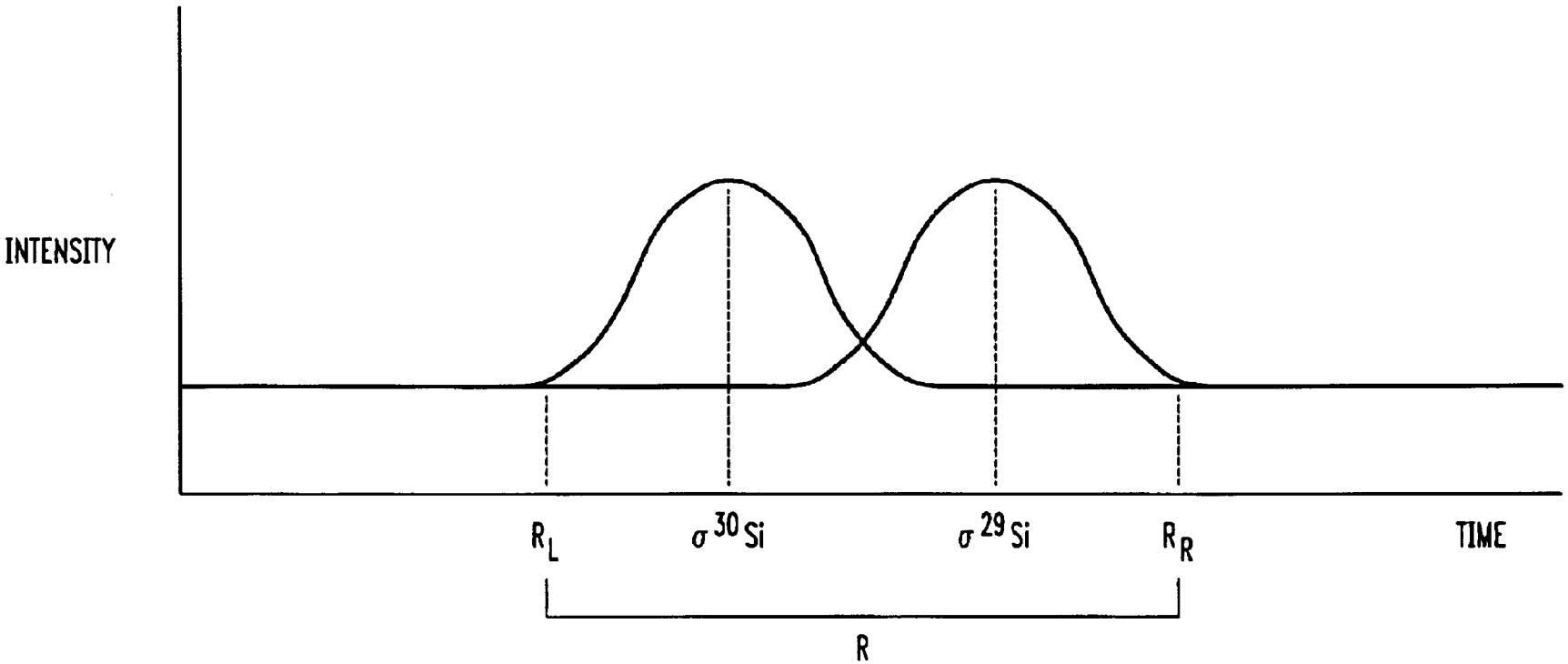
FIG. 3 is a graphic display of a mass spectral analysis of isotopic effluents illustrating planarity of a semiconductor device.
Figure 4:
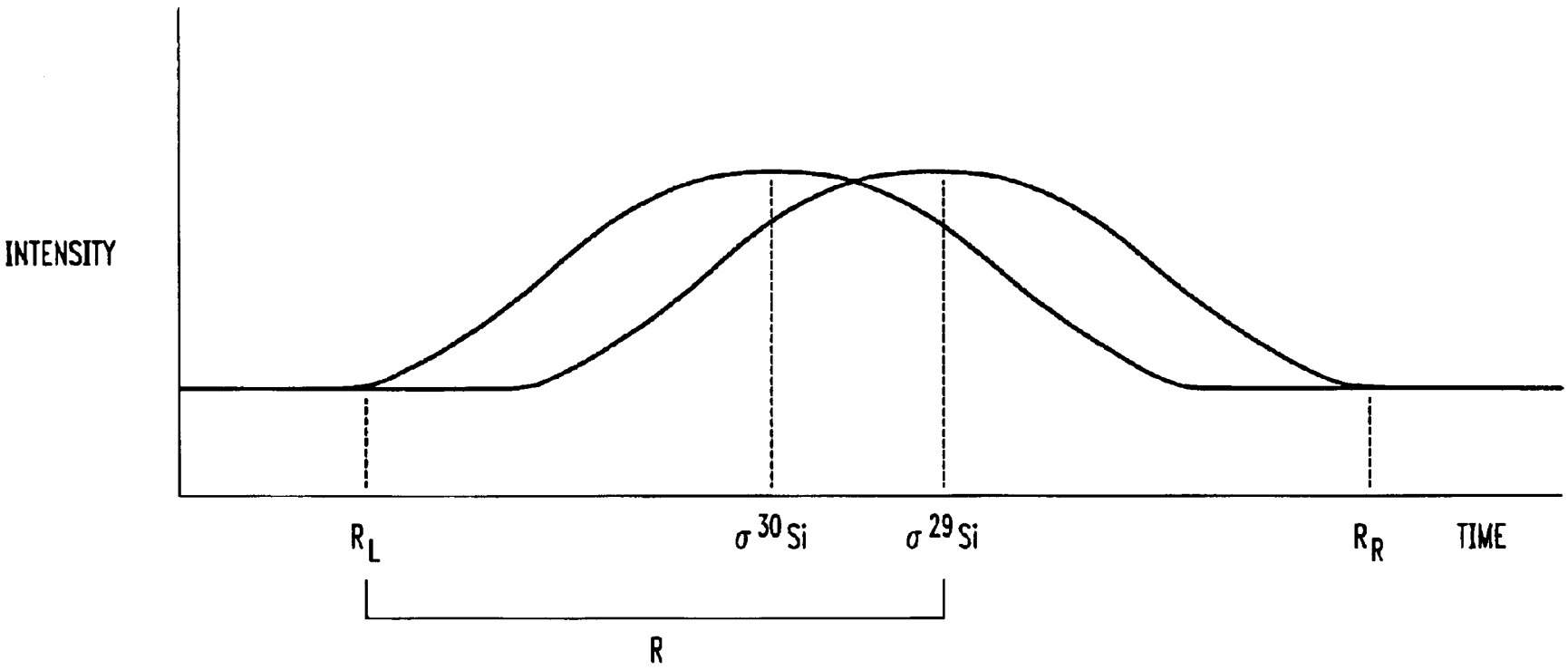
FIG. 4 is a graphic display of a mass spectral analysis of isotopic effluents illustrating poor planarity of a semiconductor device.

With respect to FIGS. 3 and 4, a mass spectrum illustrates the detection of isotope $Si^{30}$, which is found in the first sacrificial layer 15, and the detection of the isotope $Si^{29}$, which is found in the last sacrificial layer. The spectra display a measurement of the intensity of an isotope versus time. The symbol σ represents the mean intensity maximum of a given isotope and symbol R represents the time range within which the isotopic effluents from the CMP process are detected.

The endpoint of the CMP process may be monitored by the appearance and disappearance of the isotope in the effluent on the mass spectra displayed during the CMP process; however, a time delay exists between the removal of isotopes and the detection of the isotopes by the mass spectrometer. Accordingly, the endpoint is empirically determined as a function of time and isotopic intensity. The amount of time is calculated for the polishing stage to reach an endpoint after the mass spectrometer detects a predetermined concentration or intensity level of the isotope, $Si^{29}$. Once the mass spectrometer detects the predetermined intensity of the isotope, $Si^{29}$, the mass spectrometer generates an endpoint signal responsive to this parameter, which signal is communicated to the polishing tool. The polishing tool is programmed to respond to the signal by shutting down and stopping the planarization process after a preset timed duration has elapsed.

The symbol $R_L$ represents a time point when the first isotope, $Si^{30}$, is first detected, or shortly after the first sacrificial layer 15 begins to be removed from the semiconductor device. The $R_R$ represents the point in time when the isotope, $Si^{29}$, is last detected or the last sacrificial layer 16 has been removed from the device thereby determining an endpoint of the CMP. The points $R_L$ and $R_R$, are within a time range where minimum intensity levels of the isotopes are detected above a base line 27.

Planarity of the device is determined based on a comparison of the time differential of the maximum intensities of the isotope, $Si^{30}$, and the isotope, $Si^{29}$, relative to the time range within which the isotopes are detected. The greater the differential between the maximum intensities of the isotopes, $Si^{29}$ and $Si^{30}$, with respect to the time range translates to a smaller differential of the mean topographic variance of the device. Conversely, a less planar device, or a device having a greater differential in its mean topographic variance, will produce a smaller differential between the intensities of the isotopes, $Si^{29}$ and $Si^{30}$, in comparison to the range differential. Thus planarity may be calculated using the following equation:

$$P = \frac{\sigma^{29} - \sigma^{30}}{R_R - R_L}$$

Planarity, P, is calculated as an absolute number that falls within a range of numbers having been determined to represent acceptable levels of planarization for a device.

The first mass spectrum shown in FIG. 3 represents an example of semiconductor device having an acceptable level of planarity. The peaks of the isotopes, $Si^{30}$ and $Si^{29}$, are narrow and a distinct transition exists between the peaks and maximum intensities. The spectrum represents that the sacrificial layers have a relatively uniform thickness and a planar surface. When the first layer 16 is substantially removed, the mass spectrum begins to indicate the removal of the last layer 15.

With respect to FIG. 4, a spectrum is shown representing an example of a semiconductor device having poor planarity or a greater differential in the mean topographic variance of the sacrificial layers and the dielectric material. A significant differential in mean topographic variance is the result of non-uniform thickness. Such a topographic surface will produce much broader peaks on the spectrum as the isotopes are detected over a longer period of time, and the maximum intensities are closer. Indeed, before a maximum intensity of the first isotope is reached, significant amounts of the second isotope, $Si^{29}$, are detected thereby blurring the transition between the two sacrificial layers.

While the preferred embodiments of the present invention have been shown and described herein, it will be obvious that such embodiments are provided by way of example only and not of limitation. Numerous variations, changes and substitutions will occur to those of skilled in the art without departing from the teaching of the present invention. Accordingly, it is intended that the invention be interpreted within the full spirit and scope of the appended claims.

What we claim as our invention is:

1. A method for measuring metrological characteristics of a semiconductor device layer during chemical mechanical polishing of a semiconductor device, having a device layer composed of a device material, comprising the steps of:

(a) forming a last sacrificial layer within a device layer wherein the last sacrificial layer includes a first spiking material with a known atomic mass;

(b) forming a first sacrificial layer within the device layer overlaying the last sacrificial layer, wherein the last sacrificial layer includes a second spiking material with a known atomic mass different from the atomic mass of the first spiking material;

(c) chemical mechanical polishing the first sacrificial layer and the last sacrificial layer thereby producing an effluent containing the spiking materials of the first and last sacrificial layers during polishing; and (d) measuring the concentration in the effluent of the spiking materials of the first sacrificial layer and the last sacrificial layer during a time of polishing of the device to determine characteristics of the polished layer.

2. The method of claim 1 and including the step of measuring spiking material concentration during a predetermined time interval.

3. The method of claim 2 wherein the measuring step includes detecting a minimum concentration of the first spiking material at a predetermined point in time within said time interval, and further including the step of stopping the polishing upon detecting said minimum concentration of the spiking material.

4. The method of claim 2 wherein said measuring step includes the step of providing a polishing tool supported in a tool chamber and a mass spectrometer in fluid communication with said tool chamber, and introducing trace samples of the effluent into the mass spectrometer, and said trace samples containing trace amounts of the spiking materials of the first sacrificial layer and the last sacrificial layer, and detecting a concentration of ions of the spiking materials, generated in the mass spectrometer, within a predetermined time interval.

5. The method of claim 4 wherein said measuring step further includes the steps of detecting a minimum concentration of ions of the spiking material from the last sacrificial layer at a predetermined interval, and generating an endpoint signal responsive to the detection of the minimum concentration of ions of the spiking material, and further including the step of stopping the polishing of the semiconductor devise responsive to the generated endpoint signal.

6. The method of claim 4 wherein said measuring step includes the steps of calculating a time delay between the detection of the minimum concentration of ions of the spiking material of the last sacrificial layer and an endpoint of the polishing, generating an endpoint signal responsive to the detection of the minimum concentration of ions of the spiking material of the last sacrificial layer, and stopping the polishing after said time delay has elapsed in response to generation of the endpoint signal.

7. The method of claim 4 wherein the measuring step includes detecting the concentration of ions of the spiking materials in the effluent produced during the device polishing time, and comparing the concentration of ions of the spiking material of the first sacrificial layer to the concentration of ions of the spiking material of the last sacrificial layer, detected over said polishing time, to determine a planarity of the semiconductor device.

8. The method of claim 7 further including the step of calculating the planarity of the device according to the following equation $$P = \frac{\sigma^{29} - \sigma^{30}}{R_R - R_L}$$

wherein $\sigma^{30}$ is the maximum intensity of the spiking material of the first sacrificial layer, $\sigma^{29}$ is the maximum intensity of the spiking material of the last sacrificial layer, $R_L$ is a point in time within said time interval at which a minimum concentration of the spiking material of the first sacrificial layer is detected before the maximum intensity of the spiking material of the first sacrificial layer is detected, and $R_R$ is a point in time within said time interval at which a minimum concentration of the spiking material is detected after the maximum intensity of the spiking material of the second sacrificial layer is detected.

9. The method of claim 8 further including the step of introducing a gaseous form of the device material, for a predetermined time duration, into a chemical vapor deposition chamber for the deposition of the device material on the semiconductor device, and introducing a gaseous form of the first spiking material with the device material for a second predetermined time duration into the chemical vapor deposition chamber, and introducing a gaseous form of the second spiking material with the device material for a third predetermined time duration into the chemical vapor deposition chamber.

10. The method of claim 8 wherein the steps of introducing the first spiking material and the second spiking materials includes implanting the first spiking material into the device layer, at a predetermined thickness of the device layer, using an ion implantation process, and implanting the second spiking material into the device layer above the first spiking material using an ion implantation process.

11. The method of claim 1 wherein the measuring step includes detecting the concentration of the spiking materials in the effluent produced during the device polishing time, and comparing the concentration of the spiking material of the first sacrificial layer to the concentration of the spiking material of the last sacrificial layer detected over said polishing time, to determine a planarity of the semiconductor device.

12. The method of claim 11 further including the step of identifying a maximum intensity of the spiking material in the first sacrificial layer and a maximum intensity of the spiking material in the last sacrificial layer, and comparing the maximum intensities of the spiking materials over said polishing time.

13. A method for measuring metrological requirements of the chemical mechanical polishing of a semiconductor device, using a polishing tool supported within a tool chamber whereby the polishing produces a gaseous effluent during said polishing, and said method comprising the steps of:

(a) introducing a first spiking material into a device layer of a semiconductor device, at a predetermined depth of the device layer, and said spiking material dispersed within a predetermined thickness of the device layer;

(b) introducing a second spiking material to the device layer at a predetermined thickness above the first spiking material, the second spiking material having an atomic mass different from an atomic mass of the first spiking material;

(c) introducing trace samples of the gaseous effluent into a measuring system in fluid communication with the tool chamber, during the polishing of the semiconductor device; and, (d) measuring an abundance of the first spiking material and the second spiking material over a predetermined time duration in an effluent produced during polishing of the semiconductor device.

14. The method of claim 13 further including the step of generating an endpoint signal responsive to the detection of a minimum abundance of the second spiking material and stopping the polishing of the device responsive to the endpoint signal.

15. The method of claim 14 further including the step of identifying a maximum intensity of the first spiking material in the effluent and a maximum intensity of the second spiking material in the effluent, and comparing the maximum intensities of the first and second spiking materials over said predetermined time duration.

16. The method of claim 13 said measuring step includes the step of providing a mass spectrometer in fluid communication with the tool chamber, and introducing trace samples of the effluent gas into the mass spectrometer, and said trace samples effluent containing the first spiking material and the second spiking material, and detecting ions of the first and second spiking materials, generated in the mass spectrometer, over a predetermined time duration.

17. The method of claim 13 wherein said measuring step further includes the steps of detecting a minimum abundance of ions of the second spiking material at a predetermined point in time within said time duration, and generating an endpoint signal responsive to the detection of the minimum abundance of ions of the second spiking material and further including the step of stopping the polishing of the semiconductor device responsive to the generated endpoint signal.

18. The method of claim 13 wherein the detection step includes detecting the abundance of the spiking materials released during the polishing of the device, and comparing the abundance of the first spiking material to the abundance of the second spiking material, detected during polishing, to determine a planarity of the semiconductor device.

19. The method of claim 18 further including the step of calculating the planarity of the device according to the following equation $$P = \frac{\sigma^{29} - \sigma^{30}}{R_R - R_L}$$

wherein $\sigma^{30}$ is the maximum intensity of the spiking material of the first sacrificial layer, $\sigma^{29}$ is the maximum intensity of the spiking material of the last sacrificial layer, $R_L$ is a point in time within said time interval at which a minimum concentration of the spiking material of the first sacrificial layer is detected before the maximum intensity of the spiking material of the first sacrificial layer is detected, and $R_R$ is a point in time within said time interval at which a minimum concentration of the spiking material is detected after the maximum intensity of the spiking material of the second sacrificial layer is detected.

20. The method of claim 19 further including the step of providing isotopic variations of a material comprising the dielectric material.

21. The method of claim 20 further including the step of providing boron as the first spiking material and argon as the second spiking material.

22. A method of fabricating a structure, comprising the steps of:

(a) providing at least one material within a layer formed on a substrate, and said at least one material having at least two isotopic variations in atomic mass, wherein a change in the atomic mass with respect to said at least one material is a function of layer thickness;

(b) removing at least a portion of the layer from the substrate;

(c) detecting the presence of each of the at least two variations of atomic mass of said at least one material during removal of the layer; and (d) terminating the removal of the layer at a predetermined threshold of concentration of the isotopic variations indicative of an endpoint of the removal of said portion of the layer.

23. The method of claim 22 wherein said providing step comprises providing at least two materials, chemically distinct from one another, within the layer with each material having a different atomic mass.

24. The method of claim 22 wherein the step of detecting comprises the step of measuring the concentration of each of the at least two variations of the material during removal of the layer.

25. The method of claim 24 wherein said predetermined threshold is a minimum concentration of the at least one material indicative of an end point of the removal of the layer.

26. The method of claim 25 wherein a change in concentration of the at least one material is monitored over a predetermined time duration.

27. The method of claim 22 wherein the change in atomic mass of the at least one material is monitored to determine a planarity of a surface of the structure.

28. The method of claim 27 wherein the change in atomic mass is monitored over a predetermined time duration, and said predetermined threshold is a minimum abundance of the material detected within said predetermined time duration.

* * * * *